US006041563A

United States Patent [19]

Vollers

[11] Patent Number: 6,041,563

[45] Date of Patent: Mar. 28, 2000

[54] FIXING DEVICE FOR FIXING PANELS TO A BUILDING, AND BUILDING PROVIDED WITH PANELS FIXED WITH SAID FIXING DEVICE

[76] Inventor: Karel Jan Vollers, Overtoom 433, NL-1054 KE Amsterdam, Netherlands

[21] Appl. No.: 09/068,120

[22] PCT Filed: Jul. 1, 1996

[86] PCT No.: PCT/NL96/00270

§ 371 Date: Dec. 15, 1997

§ 102(e) Date: Dec. 15, 1997

[87] PCT Pub. No.: WO97/01685

PCT Pub. Date: Jan. 16, 1997

[30] Foreign Application Priority Data

Jun. 29, 1995 [NL] Netherlands ..... 1000698

[51] Int. Cl.[7] ..... E04B 1/00

[52] U.S. Cl. ..... 52/281; 52/271; 52/582.1; 52/235

[58] Field of Search ..... 52/235, 582.1, 52/281, 271

[56] References Cited

U.S. PATENT DOCUMENTS

| | | | |
|---|---|---|---|
| 1,834,512 | 12/1931 | Asmus . | |
| 3,256,655 | 6/1966 | Teeter | 52/281 |
| 3,559,352 | 2/1971 | Magnuson | 52/281 |
| 4,750,310 | 6/1988 | Holcombe | 52/235 |
| 4,953,333 | 9/1990 | Carlson | 52/281 |
| 5,245,808 | 9/1993 | Grunewald et al. | 52/235 |
| 5,363,616 | 11/1994 | Hernandez | 52/281 |

FOREIGN PATENT DOCUMENTS

| | | |
|---|---|---|
| 0 436 868 | 7/1991 | European Pat. Off. . |
| 88 11 181 | 11/1988 | Germany . |
| 2 224 762 | 5/1990 | United Kingdom . |
| WO 93/16249 | 8/1993 | WIPO . |

*Primary Examiner*—Carl D. Friedman
*Assistant Examiner*—Dennis L. Dorsey
*Attorney, Agent, or Firm*—Young & Thompson

[57] ABSTRACT

The invention relates to a fixing device for fixing at least one facing panel (4) to a building. The fixing device comprises at least one frame section (2) which can form part of a framework (1) to be fitted around the facing panel (4). The fixing device also has at least one supporting part (10) for fixing to a floor, ceiling or partitioning wall of a building. The at least one frame section (2) and at least one supporting part (10) can be interconnected by connecting means (11), which permit pivoting of the supporting part (10) relative to the frame section (2) during fitting of the frame section (2) on the building, in such a way that the facing panel (4) can be fixed to the floor, the ceiling or the partitioning wall at an oblique angle relative to the plane of the floor, the ceiling or the partitioning wall respectively. The connecting means (11) can comprise a ball hinge or line hinge. The supporting part (10) and the frame section (2) can be an extruded section, while the connecting elements (11) can be convex cylindrical or concave cylindrical connecting elements (11). The invention also relates to a building provided with a fixing device according to the invention.

13 Claims, 2 Drawing Sheets

FIXING DEVICE FOR FIXING PANELS TO A BUILDING, AND BUILDING PROVIDED WITH PANELS FIXED WITH SAID FIXING DEVICE

The present invention relates to a fixing device for fixing at least one panel, such as in particular a facing panel, to a building, in which the fixing device comprises at least one frame section which can form part of a framework to be fitted at one side of the panel, and at least one supporting part for fixing to a floor, ceiling, partitioning wall or structural part of a building, in which the at least one frame section is provided with at least one first connecting part, in which the at least one supporting part is provided with at least one second connecting part, in which the at least one frame section and at least one supporting part can be interconnected by way of said connecting parts, and in which the connecting parts, viewed in the connected state and in a cross-sectional plane at right angles to the lengthwise direction of the frame section, form at least one essentially circular arc-shaped connection.

Panels in this context should be understood as including cladding sheets for fitting in particular on the outside of buildings, both transparent and non-transparent sheets such as, for example, panes and aluminium or plastic cladding sheets respectively, but they also include roof panels. However, the fixing device according to the invention can also be used for facing panels to be fitted in the inside of a building, and for wall, floor and ceiling panels to be fitted on the inside of a building.

Framework in this context should be understood as meaning a frame which is fitted in order to fix or anchor such a panel at two or more sides, by means of which frame such a panel can be fixed to a building. The framework may also be fitted around the panel, if desired.

Such fixing devices are generally known per se.

In the case of large buildings, in particular high-rise buildings, it is currently general practice to construct a building from a concrete skeleton structure which is clad on the outside with facing panels such as panes and non-transparent cladding panels. In the case of such concrete skeleton buildings, concrete outside walls are often not provided, but the outside walls are produced by fitting non-load-bearing facing panels. In this case said facing panels are fixed to the ends of floors and/or ceilings, and/or inside walls situated at the outer sides of the building. Such facing panels are generally fixed in such a way that the reference plane of the facing panel, at least near its fixing point, is perpendicular to the central longitudinal plane of the corresponding floor, the corresponding ceiling or the corresponding partitioning wall. However, if the facing panel has to be fixed to the building at an angle other than 90° relative to the central longitudinal plane of the corresponding ceiling, the corresponding floor or the corresponding partitioning wall, special constructional measures have to be taken. The ceilings, floors and partitioning walls used in such skeleton building are generally concrete slabs always having right-angled transitions between the adjacent external faces of the concrete slab. This means that when a facing panel is fixed to such a concrete slab at an angle other than 90°, a line contact, instead of a flat contact, will then be formed between said concrete slab and the facing panel. This produces, as it were, a triangular space between the facing panel and the corresponding concrete slab. This triangular space must be filled up, in order to ensure a sturdy, stable fixing, which is a laborious and time-consuming operation. Another method can be to provide the facing panel with a frame section which surrounds the facing panel, the surrounding frame section being provided with a suitable profile at the position of the so-called oblique fixing, in such a way that a flat contact is still obtained. However, such sections with an adapted profile mean that fitting is possible only at a set, fixed angle. Other sections have to be manufactured for other angles. It will be clear that this is laborious and expensive.

A fixing device of the type mentioned at the beginning is known from, for example, European Patent Application EP-0,436,868. In FIGS. 15, 16 and 17 in particular, this application discloses a fixing device comprising a supporting part in the form of an essentially rectangular tubular section which at one side is provided with convex cylindrical connecting part 79, and comprising a two-part frame section, each frame section part being provided with a concave cylindrical connecting part 80, 81, the first concave cylindrical connecting part of which also forms a further convex cylindrical connecting part. The concave/convex cylindrical part 80 is placed over the convex cylindrical part 79, and a concave cylindrical connecting part 81 is placed over the assembly of the convex cylindrical connecting part 79 and concave/convex cylindrical connecting part 80. In the connected state, two parallel "circular arc-shaped connections" are formed in this way. The frame section parts in this case have some freedom of movement relative to each other, as a result of the fact that they are rotatable independently through a small angle relative to the common convex cylindrical connecting part 79. The frame section parts in this case are also rotatable jointly through several degrees relative to the convex cylindrical connecting part 79. The fact that the frame section parts are jointly rotatable relative to the supporting part means that it is possible to fix the facing panels at angles which are adjustable to a limited extent relative to the supporting part. Owing to the limited freedom of movement of the frame section parts relative to each other, it is also possible within limits to place adjoining facing panels at different angles relative to each other.

However, the fixing device according to EP-0,436,868 has the great disadvantage that during the rotation of the frame section parts together, or of each frame section part individually, the so-called reference planes of the facing panels to be fitted undergo a translation movement. This means that for establishing the measurements of the facing panels, measurements which are generally calcuated beforehand and not made at the building, the calculations are complex and extensive.

It will be clear that the abovementioned disadvantages greatly limit the freedom of shape of the buildings provided with facing panels, or at any rate their realization at reasonable cost. This problem is important in particular if the outside walls of a buildings provided with facing panels run in a curvature. Such a curvature can be achieved by faceting, i.e. by linking together essentially flat panels which are always fitted at an angle to each other, but it is also conceivable to make use of precurved panels. An example of this is a tower structure which is twisted. Compare, for example, a member of square or rectangular cross-section which is slightly twisted in its lengthwise direction. Using such twisting on buildings means that optically pleasing effects can be achieved, but until now this has led to considerable costs when such a building is clad with facing panels.

The object of the present invention is to overcome the abovementioned problems by providing an improved fixing device of the type indicated at the beginning.

In particular, the object of the present invention is to provide a fixing device for fixing at least one facing panel to a building, whereby great freedom of shape as regards the outside walls of the building is possible, and whereby this can be achieved at reasonable cost by providing a universal fixing device.

This object is achieved according to the invention by a fixing device for fixing at least one panel, such as in particular a facing panel, to a building, in which the fixing device comprises at least one frame section which can form part of a framework to be fitted on a side of the panel, and at least one supporting part for fixing to a floor, ceiling, partitioning wall or structural part of a building, in which the at least one frame section is provided with at least one first connecting part, in which the at least one supporting part is provided with at least one second connecting part, in which the at least one frame section and at least one connecting part can be interconnected by way of said connecting parts, and in which the connecting parts, viewed in the connected state and in a cross-sectional plane at right angles to the lengthwise direction of the frame section, form at least one essentially circular arc-shaped connection, characterized in that, viewed in the connected state and in a cross-sectional plane at right angles to the lengthwise direction of the frame section, the centre point of the at least one circular arc-shaped connection essentially lies in or near the envisaged reference plane of the at least one panel to be fitted.

By forming the fixing device in such a way that the centre point of the combined first end second connecting parts lies essentially in or near the envisaged reference plane of the facing panels to be fitted, it is ensured that when the position of the facing panels relative to the building is changed, the line of intersection of the reference planes of the facing panels with the centre point of the circular arc-shaped connection(s) always remains a fixed or virtually fixed line defined by the fixing device. The advantage of this is that the so-called centre point of the circular arc-shaped connection can be used as a fixed point or fixed line determined by the fixing device, while this fixed point or this fixed line always remains in the same position, almost entirely irrespective of the position of the facing panels relative to the building. The advantage of this is that when the position of one panel or of some panels in a building is changed relative to the building, only the dimensions of these facing panels change, and the dimensions of other panels which do not need to change position remain unchanged. As a result of this, the calculations for determining the dimensions of the required facing panels of a building are greatly simplified. Moreover, the position of facing panels relative to the building can then still be changed during the design phase, during building or even after building, without this having any effect on the remaining facing panels or the fixing point(s) of the remaining fixing device for fixing facing panels to the building. It is therefore possible according to the invention to achieve buildings of very complex external geometry clad with facing panels (for example, outside wall faces curved both in the horizontal and in the vertical direction), while the design calculations for the dimensions of the facing panels can be kept relatively simple as a result of the "fixed" reference points. By linking the position and shape of the abovementioned fixed line or points to the geometry of, for example, the structural planes of a building, such as horizontal floors or columns or load-bearing walls situated in parallel vertical planes, or to functional faces such as horizontal parapets, it is possible to bring together two different planes in the fixing line or fixing points: the reference plane of the outside wall and the structural plane of the building. As described above, a great repetition in the connections and section measurements occurs here, both in the reference plane and in the structural planes. For example, the floor edge can be curved in only one direction, while the outside wall is curved both in the vertical and in the horizontal direction.

According to an advantageous embodiment of the invention, the connecting parts permit pivoting of the supporting part relative to the frame section during fitting of the frame section on the building, in such a way that the panel can be fixed to the floor, the ceiling or the partitioning wall at an oblique angle, i.e. an angle other than 90°, relative to the plane of the floor, the ceiling or the partitioning wall, or a structural part, respectively. The supporting part can also be fixed to other structural parts, such as support columns or reinforcement sections, or load-bearing parts, or structures lying behind.

The use of connecting means permitting pivoting of the frame section relative to the building during fitting of the frame section on the building results in an adjustment facility by means of which it is possible to work with one and the same fixing device, irrespective of the fitting angle of the facing panel relative to the panel-shaped building part (such as a ceiling, floor or partitioning wall). Great freedom of connection as regards the angular position is achieved in this way. The fixing device according to the invention is thus universally usable. It is possible with one and the same fixing device to fix the facing panel as desired at an angle other than 90° relative to a slab part of the building, but also at an angle of 90° relative to such a slab part. In this case it is no longer necessary to fit filler pieces. With the fixing device according to the invention, it is thus possible to achieve a building provided with facing panels with great freedom of shape at relatively low cost. A facing panel according to the invention in practice will be fixed by means of a number of connecting means, which are fixed to various side edges of the panel, so that the pivoting facility ceases automatically after fixing. It is also conceivable, if desired, to fix the hinge after the facing panel has been fixed to the building.

According to the invention, ball hinges and/or line hinges can be used as the connecting means which permit pivoting during fitting.

With a view to establishing the measurements in a systematic way, and to simple fitting, also in, for example, curved panels, it is advantageous according to the invention if the connecting means have a pivot point which lies in the reference plane of the at least one facing panel to be fitted. In the case of such a position of the pivot point, if it is fitted at an angle, the facing panel will not undergo lateral movement relative to the floor, the ceiling or the partitioning wall to which it is fixed.

According to a very advantageous embodiment of the invention, the supporting part comprises an extruded casing section which is provided with means, such as bolt holes or anchoring slots, for fixing it to a floor, ceiling or partitioning wall, and with a convex cylindrical or concave cylindrical connecting element co-moulded during the extrusion and extending in the lengthwise direction of the casing section, and the at least one frame section is provided with a complementary concave cylindrical or convex cylindrical connecting element, respectively. In this embodiment it is therefore a matter of a so-called line hinge, which is formed by the convex cylindrical or concave cylindrical connecting element on the frame section acting upon the respective concave or convex cylindrical connecting element on the frame section.

A casing section in this context should be understood as meaning a section which is fixed essentially immovably to the building itself. Such a section can be essentially strip-shaped with a convex cylindrical or concave cylindrical connecting element on one longitudinal side. The strip itself can then be provided with through holes, for easy fixing thereof by means of bolts on the large external surface of a floor, ceiling or partitioning wall; but it is equally very conceivable for the casing section to comprise a tubular section with a convex cylindrical or concave cylindrical connecting element moulded onto it. This can have great advantages from the point of view of strength.

A frame section here should be understood as meaning in particular a section part which is fixed essentially immovably to the facing panel. Such frame sections, which are known per se, are generally formed by extrusion. A concave cylindrical or convex cylindrical connecting element can then be fixed relatively easily thereto. In the case of extrusion this is simple to achieve by co-extruding such a concave cylindrical or convex cylindrical connecting element. On the side of the building, such a frame section can be essentially in one piece, for supporting two adjoining facing panels relative to each other in a fixed manner, but such a frame section can also be in two pieces, for example as disclosed in EP-0,436,868, in order to be able to set the angle between two adjoining facing panels.

The frame section advantageously forms part of a framework which is provided with a profile for a flat junction to the facing panel to be fixed. Frameworks provided with a profile for a flat junction to the facing panel to be fixed are generally known per se. The frame section advantageously and simply can form part of said framework. For example, concave cylindrical or convex cylindrical connecting elements are easy to integrate with an extruded section part of such a framework.

The flat junction according to the invention advantageously comprises an essentially U-shaped accommodation slot for a facing panel, in which a leg of the U-shaped accommodation slot is preferably formed by a removable, so-called glazing bead. It should be pointed out here that the choice of the term "glazing bead" in no way implies that the facing panel must be a glass sheet. The facing panel can equally be a sheet of another material, transparent or otherwise.

The invention also relates to a building provided with facing panels, in which at least one facing panel is fixed at least partially to the building by means of a fixing device according to the invention.

In particular, the invention also relates to a building provided with facing panels, in which at least one facing panel is fixed at least partially to the building by means of a fixing device according to the invention, and in which said at least one facing panel is fixed to the building in such a way that the reference plane of the facing panel intersects the longitudinal plane of a floor or ceiling or partitioning wall to which it is fixed at an oblique angle (i.e. the reference plane of the facing panel forms an angle other then 90° with the floor, the ceiling or the partitioning wall).

Reference plane here should be understood as meaning the plane to which the establishment of the measurements of the other planes of the outside wall is related. This is an important principle in particular in the case of curved outside walls, because the resulting curvature on the inside and the outside is different there. The reference plane is then the imaginary plane in the outside wall from which the measurements for the parts in parallel zones are established. It is advantageous to place the centre of rotation of the fixing device in this reference plane, because in this way a repeat is obtained in parts and connections.

The central longitudinal plane of the facing panels is generally taken as the reference plane. It will then be clear that, if the fixing device is designed for facing panels of an envisaged thickness, the reference plane shifts when facing panels of a different thickness are used. The actual reference plane and the so-called "centre point of the circular arc-shaped connection" will then no longer intersect each other. The so-called "centre point of the circular arc-shaped connection" will, however, still lie very close to the actual reference plane, so that this has no great influence on establishing the measurements of the facing panels, as a result of which this situation of no longer intersecting can be disregarded when establishing the measurements of the panels. How great the offset between the so-called "centre point of the circular arc-shaped connection" and the actual reference plane may be in order to be able to disregard said offset when determining the panel dimensions will depend, inter alia, on the ratio of the span dimensions of the panel relative to its thickness, and on other factors. This is easily estimated by an average person skilled in the art. Of course, with regard to the offset discussed above, the reverse also applies. Assuming that the envisaged reference plane will also be the actual reference plane, the so-called "centre point of the circular arc-shaped connection" can also be placed near the envisaged/actual reference plane when the fixing device is being designed.

If the thickness of the fitted facing panel is lower than the thickness of the facing panel envisaged when the fixing device is being designed, the offset between the ultimate reference plane and the "centre point of the circular arc-shaped connection" can be reduced or prevented entirely by providing filler pieces at the position where the panel is fixed to the fixing device. This principle of compensation of the offset can also be used in the design phase of the fixing device by designing the fixing device according to the invention for fixing a relatively thick facing panel and using filler pieces of suitable thickness, depending on the thickness of the thinner facing panel used.

The at least one facing panel in this case can comprise a pane which is transparent in one or two directions, or a non-transparent cladding sheet, or a roofing sheet or an insulation sheet.

The invention also relates to a supporting part for use in the case of a fixing device according to the invention.

The invention further relates to a frame section suitable for use in the case of a fixing device according to the invention.

The present invention will be explained in greater detail below, only by way of example, with reference to drawings. In the drawings.

Figure 1:
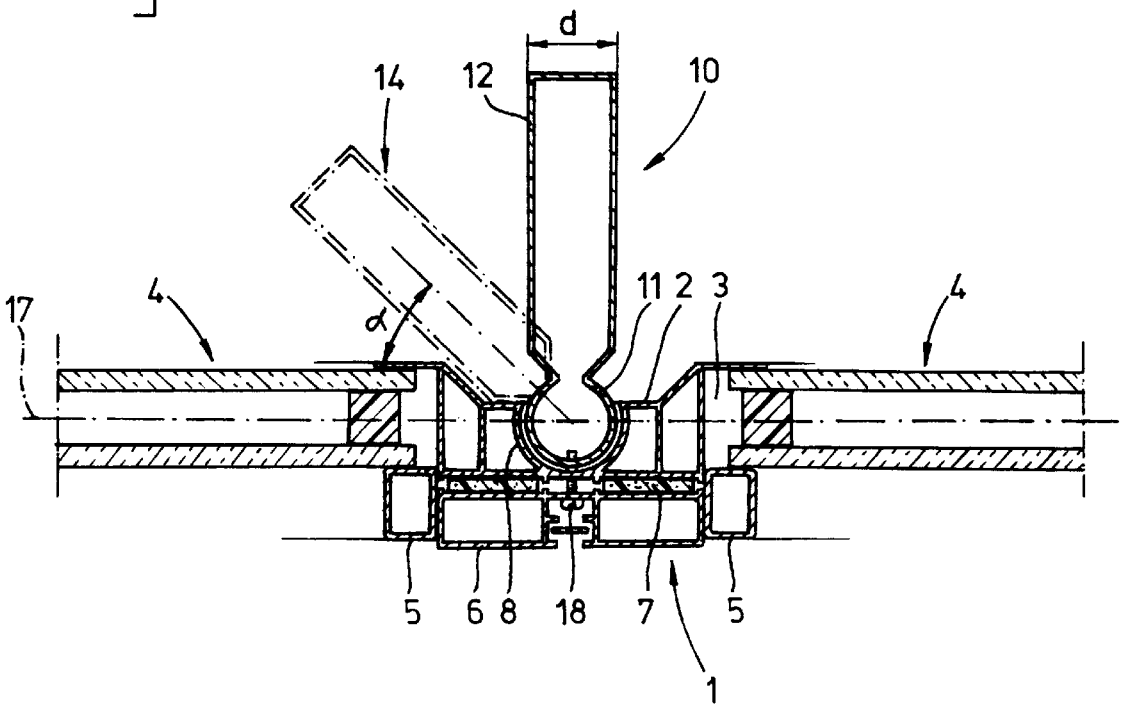
FIG. 1 shows diagrammatically, in cross-section a detail of a fixing device according to the invention.

FIG. 1 shows in cross-section a part of a framework 1, comprising a frame section 2, U-shaped accommodation slots 3 for a facing panel 4, glazing beads 5, an exposed face 6 of a frame section, and an insulating material 7. The facing panel 4 in this case is a double-glazed pane. The frame section 2 is provided with a concave cylindrical connecting element 8. i.e. a recess, the inside wall of which corresponds to a part of a cylinder. The framework 1 is of a design which is conventional per se, which differs from the known designs essentially through the frame section 2, which is provided with a concave cylindrical connecting element. The facing panel 4 is easy to remove and fit, as a result of the removable so-called glazing beads 5. FIG. 1 also shows in cross-section a supporting part 10, which at one end is provided with a connecting element 11. Said connecting element 11 can be cylindrical, but it can also be spherical. If the connecting element 11 is spherical, the arm 12 of the supporting part 10 will generally form a bar-shaped arm extending away from the connecting element 11. It is therefore conceivable in this case for a spherical connecting element 11 to engage in a cylindrical connecting element 8.

Reference number 14 indicates in dashed and dotted lines a supporting part 10 rotated relative to the frame section 2. The supporting part 14 forms an acute angle α with the facing panel 4. It will be clear that a hinged connection is provided between the supporting part 10 and the frame part 2. Arm 12 can be screwed down laterally or endwise on a wall, ceiling, floor or column. If arm 12 is a bar-shaped part, it is also conceivable for it to be anchored in a column, wall, floor or ceiling. It will be clear that 2 facing panels can be fixed by means of the fixing device 10 at an oblique angle relative to a floor, ceiling, wall or column. This will become clearer further on with reference to FIGS. 2, 3 and 4.

Supporting part 10 can also be an extruded section, and in this case is referred to as a casing section, a cross-section of which is shown in FIG. 1. The casing section 10 then consists of a tubular arm part 12 and a cylindrical part 11 moulded thereon. The tubular arm part 12 can also be solid and if the thickness d is made smaller, it can be plate-shaped.

The supporting part 10 can be fixed relative to the frame section 2 by means of a screw 18. To this end, screw bores can be formed at suitable points in the cylindrical part 11 of the supporting part 10, which bores permit a multiplicity of oblique positions of the supporting part 10 relative to the frame section 2, but it is also conceivable for the screw 18 to be a self-tapping screw, which itself can form a bore in the connecting element 11.

It is also conceivable for connecting element 11 to engage in a press fit in the cylindrical cavity 8 or snap into said cavity. An interlocking between connecting element 11 and the cylindrical cavity 8 which is in principle unbreakable can also be obtained if the cylindrical cavity 8 comprises over half of a cylinder circumference. The connecting element 11 can then be brought into engagement with the cylindrical cavity 8 by sliding the connecting element 11 therein in the lengthwise direction of the cylindrical cavity 8.

It will be clear that in the case of the embodiment according to FIG. 1 the frame section 2 can equally be provided with a convex cylindrical connecting element, and that the supporting part 10 can be provided with a concave cylindrical connecting element.

Figure 2:
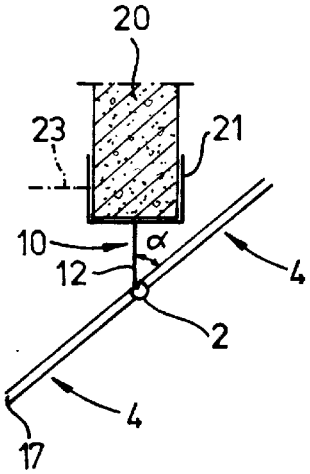
FIGS. 2, 3 and 4 show very diagrammatically embodiments of a fixing device according to the invention.

FIG. 2 shows very diagrammatically an embodiment of a fixing device according to the invention. Reference number 20 indicates an end edge of a concrete slab, such as a floor, ceiling, column or partitioning wall part. In this case 10 is a supporting part, and 2 is a frame section which if desired can form part of a framework. The supporting part 10 can be an extruded section, consisting of a U-shaped part 21 which can grip around the slab part 20, an arm part 12, and a connecting part not shown in any further detail, preferably a concave cylindrical or convex cylindrical connecting element. As indicated diagrammatically by axis 23, the U-shaped part 21 can be provided with bolt holes for fixing to the concrete slab part 20. Arm part 12 can comprise a sheet element or a tubular section.

Figure 3:
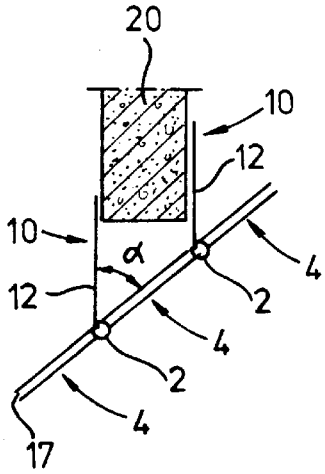

FIG. 3 also shows very diagrammatically another variant of an embodiment. The supporting part 10 in this case is not provided with a U-shaped section part 21, but the arm parts 12, which can be plate-shaped or tubular, are fixed directly against the side of the concrete slab part 20. Supporting parts 10, fitted on either side of the concrete slab part 20, are also used. The desired angle α of the facing panels 4 relative to the concrete slab part 20 can be adjusted here by sliding the two supporting parts 10 in their own lengthwise direction relative to each other. This sliding relative to each other is made possible here by the hinged connection of the supporting parts 10 to the facing panels 4.

Figure 4:
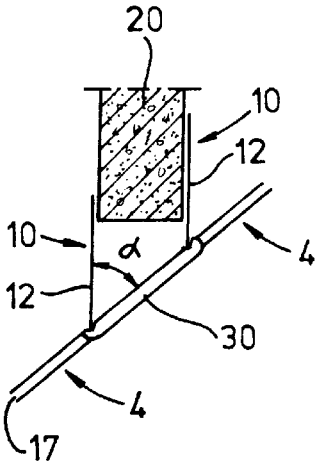

As shown in FIG. 3, a facing panel 4 is fitted between the hinged connections. However, it is also conceivable, as shown in FIG. 4, to fit between the hinged connections a separately formed frame section 30 which can vary in breadth in the facing plane at right angles to the hinged connection.

In the embodiments according to FIGS. 1 and 2 the pivot point of the connecting means lies in the reference plane 17 of the facing panels 4. Reference plane in this context should be understood as meaning a sort of central longitudinal plane of the facing panels.

It will be clear that many variants of the fixing device and the building according to the invention are conceivable. For example, it is conceivable to leave out the frame section and to fit the connecting element by means of which the facing panel is to be fixed to the supporting part in the facing panel itself, or to integrate it therewith. The fixing device according to the invention is also very suitable for use when fixing panels in the inside of a building.

Figure 5:
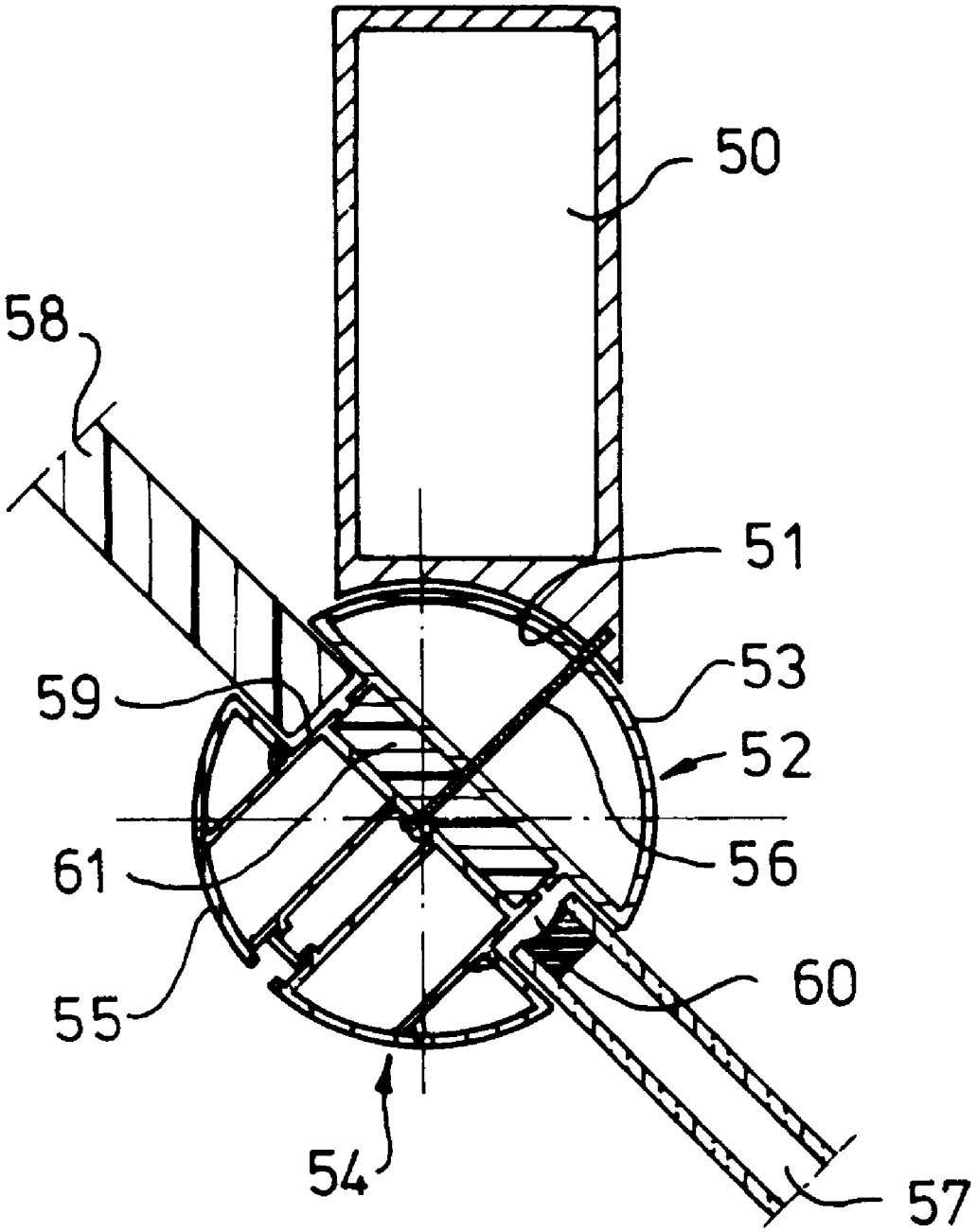
FIG. 5 shows very diagrammatically a cross-sectional view of a further embodiment of the invention.

FIG. 5 shows very diagrammatically a cross-section of a fixing device according to the invention. The fixing device consists of a tubular section 50, forming the so-called supporting part, and provided with a concave cylindrical connecting part 51 extending in the lengthwise direction of the section, and further consists of a tubular frame section 52, which is provided with a connecting part 53 which is complementary to the concave cylindrical connecting part 51 and extends in the lengthwise direction of the tubular frame section 52. A further tubular section 54 is provided at the side facing away from the building, the longitudinal face 55 of which further section is an essentially cylindrical shape. The tubular section 54 facing away from the building is screwed down on the tubular section 52 by means of a screw 56, and the whole unit of the tubular sections 54 and 52 is fixed by means of a screw 56 in a desired (rotating) position to the tubular section 50. By means of the screw 56, the tubular section 54 will be clamped towards the tubular section 52, the glass panel 57 and the non-transparent facing panel 58 in the U-shaped recesses 59 and 60. A flexible plastic material 61 is fitted between the tubular sections 54 and 52, which plastic material can be compressed under the influence of the screw 56 being tightened, and also provides heat insulation.

As will be seen clearly from FIGS. 1 and 5, filler pieces can be fitted between the panel and the legs of the U-shaped accommodation slots 3 and 59 and 60 respectively, if a thinner panel has to be accommodated herein. With a suitably selected thickness of the filler pieces, an offset between the actual reference plane and the "centre point of the circular arc-shaped connection" can then be reduced or avoided entirely.

It will be clear that, with the fixing device according to the invention, buildings placed on columns, such as ovoid buildings, can also be provided with a bottom cladding at the underside. It will also be clear that the fixing device according to the invention can also be used for floors, ceilings and walls fitted in buildings, which can then describe curved faces, faceted or otherwise.

I claim:

1. Fixing device for fixing at least one panel to a building, in which the fixing device comprises at least one frame section having a panel contact portion structured and arranged to fit an edge of said panel, and at least one supporting part adapted to be fixed to a floor, ceiling, partitioning wall or structural part of a building, in which the at least one frame section is provided with at least one first connecting part, and the at least one supporting part is provided with at least one second connecting part, the at least one frame section and at least one supporting part being interconnected by way of said connecting parts, and in which the connecting parts, viewed in a cross-sectional plane at right angles to the lengthwise direction of the frame section, contact each other along at least one essentially circular arc-shaped engagement line, wherein, viewed in a cross-sectional plane at right angles to the lengthwise direction of the frame section, on the one hand a center point of the at least one circular arc-shaped engagement line is arranged with respect to the panel contact portion so that the center point essentially lies in or near the central longitudinal plane of the at least one panel when said panel is fitted to said panel contact portion, and on the other hand the supporting part does not lie in a plane which is parallel to the central longitudinal plane.

2. Fixing device according to claim 1, wherein the connecting parts permit pivoting of the supporting part relative to the frame section.

3. Fixing device according to claim 1, wherein the connecting parts form a ball hinge.

4. Fixing device according to claim 1, wherein the supporting part comprises an extruded casing provided with means for fixing the extruded casing to a floor, ceiling, partitioning wall or structural part, and provided with a co-extruded convex cylindrical or concave cylindrical connecting element extending in the lengthwise direction of the casing section, and in that the at least one frame section is provided with a complementary concave cylindrical or convex cylindrical connecting element, respectively.

5. Fixing device according to claim 1, wherein the frame section is structured and arranged to form part of a framework in which the panel contact portion is provided with a profile for a flat junction to the panel to be fixed, viewed in cross-section of the frame section.

6. Fixing device according to claim 5, wherein the flat junction comprises an essentially U-shaped accommodation slot for a panel, in which a leg of the U-shaped accommodation slot is formed by a removable glazing bead.

7. Fixing device according to claim 1, characterized in that the supporting part comprises at least one concave cylindrical connecting part, and in that the frame section comprises a convex cylindrical connecting part extending in the lengthwise direction of said section, the concave and convex cylindrical parts being cylindrical shapes which are complementary to each other.

8. Building provided with panels, in which at least one panel is fixed at least partially to the building by means of a fixing device according to claim 1.

9. Building according to claim 8, in which the at least one panel fixed with a fixing device comprises a pane which is transparent in one or two directions, or a non-transparent cladding sheet, a roofing sheet or an insulation sheet.

10. Building provided with panels, in which at least one panel is fixed at least partially to the building by means of a fixing device according to claim 1, said at least one panel being fixed to the building in such a way that the central longitudinal plane of the panel intersects the longitudinal plane of a floor or ceiling or partitioning wall, or structural part to which it is fixed, at an oblique angle.

11. Fixing device according to claim 1, wherein the connecting parts form a line hinge.

12. Fixing device for fixing at least one panel to a building, in which the fixing device comprises at least one frame section having a panel contact portion structured and arranged to fit an edge of said panel, and at least one supporting part adapted to be fixed to a floor, ceiling, partitioning wall or structural part of a building, in which the at least one frame section is provided with at least one first connecting part, and the at least one supporting part is provided with at least one second connecting part, the at least one frame section and at least one supporting part being interconnected by way of said connecting parts, and in which the connecting parts, viewed in a cross-sectional plane at right angles to the lengthwise direction of the frame section, contact each other along at least one essentially circular arc-shaped engagement line, wherein, viewed in a cross-sectional plane at right angles to the lengthwise direction of the frame section, on the one hand a center point of the at least one circular arc-shaped engagement line is arranged with respect to the panel contact portion so that the center point essentially lies in or near the central longitudinal plane of the at least one panel when said panel is fitted to said panel contact portion, and on the other hand the supporting part lies in a plane which is not parallel to the central longitudinal plane, and wherein the connecting parts are structured and arranged provide a pivotable connection between the frame section and the supporting part.

13. Fixing device according to claim 12, wherein the connecting parts form a ball hinge.

* * * * *